US005948179A

United States Patent [19]

Hasegawa et al.

[11] Patent Number: 5,948,179

[45] Date of Patent: Sep. 7, 1999

[54] ALLOY USED FOR PRODUCTION OF A RARE-EARTH MAGNET AND METHOD FOR PRODUCING THE SAME

[75] Inventors: Hiroshi Hasegawa; Shiro Sasaki; Yoichi Hirose, all of Saitama; Shinya Fujito; Koichi Yajima, both of Tokyo, all of Japan

[73] Assignees: Showa Denko K.K.; TDK Corporation, both of Tokyo, Japan

[21] Appl. No.: 08/968,005

[22] Filed: Nov. 12, 1997

[51] Int. Cl.[6] ..... H01F 1/055

[52] U.S. Cl. ..... 148/301; 148/442; 148/303; 420/581

[58] Field of Search ..... 148/442, 301, 148/302, 303; 420/416, 581, 582, 83

[56] References Cited

U.S. PATENT DOCUMENTS

| | | | |
|---|---|---|---|
| 4,289,549 | 9/1981 | Kasai | 148/101 |
| 4,971,637 | 11/1990 | Ohashi et al. | 148/301 |
| 5,011,552 | 4/1991 | Otsuka et al. | 148/302 |
| 5,447,578 | 9/1995 | Ozaki et al. | 148/302 |
| 5,482,572 | 1/1996 | Eggert et al. | 148/101 |
| 5,647,886 | 7/1997 | Kitazawa et al. | 148/301 |

*Primary Examiner*—John Sheehan

*Attorney, Agent, or Firm*—Armstrong, Westerman, Hattori, McLeland & Naughton

[57] ABSTRACT

An alloy used for the production of a rare-earth magnet alloy, particularly the boundary-phase alloy in the two-alloy method is provided to improve the crushability.

The Alloy consists of (a) from 35 to 60% of Nd, Dy and/or Pr, and the balance being Fe, or (b) from 35 to 60% of Nd, Dy and/or Pr, and at least one element selected from the group consisting of 35% by weight or less of Co, 4% by weight or less of Cu, 3% by weight or less of Al and 3% by weight or less of Ga, and the balance being Fe. The volume fraction of $R_2Fe_{17}$ phase (Fe may be replaced with Cu, Co, Al or Ga) is 25% or more in the alloy and the average size of an $R_2Fe_{17}$ phase is 20 $\mu$m or less. The alloy can be produced by a centrifugal casting at an average accumulating rate of melt at 0.1 cm/second or less.

2 Claims, 2 Drawing Sheets

ALLOY USED FOR PRODUCTION OF A RARE-EARTH MAGNET AND METHOD FOR PRODUCING THE SAME

BACKGROUND OF INVENTION

1. Field of Invention

The present invention relates to an alloy, which becomes the raw material of a rare-earth containing magnet, and to a production method of the same. In a two-alloy mixing method being used for the production of high-performance Nd—Fe—B magnet, two alloys, i.e., an alloy having a composition close to the stoichiometric $Nd_2Fe_{14}B$ (main-phase alloy), on which the magnetism is based, and an alloy having high concentration of a rare-earth element (boundary-phase alloy) are mixed. The alloy according to the present invention is pertinent as the latter alloy.

2. Description of Related Art

All of the Nd—Fe—B magnets usually produced industrially have somewhat richer rare-earth composition than the stoichiometric $Nd_2Fe_{14}B$ composition. A phase (referred to as the R rich phase) having high concentration of a rare earth element (R), such as Nd, is therefore formed in the ingot of the magnet alloy.

It is known that the R-rich phase plays an important role as follows in the Nd based magnet.

(1) The R-rich phase has a low melting point and hence is rendered to a liquid phase in the sintering step of the magnet production process. The R-rich phase contributes, therefore,to densification of the magnet and hence enhancement of remanence.

(2) The R-rich phase eliminates the defects of the grain boundaries of the $R_2T_{14}B$ phase, which defects lead to the nucleation site of the reversed magnetic domain. The coercive force is thus enhanced.

(3) Since the R-rich phase is non-magnetic and magnetically isolates the main phases from one another, the coercive force is thus enhanced.

Development of the Nd—Fe—B magnet implemented in recent years is to furthermore enhance the magnetic properties, particularly the energy product $(BH)_{max}$. Since it is necessary to increase the volume fraction of the $Nd_2Fe_{14}B$ phase, on which the magnetism is based, in such high-performance magnet, the magnetic composition must be close to the stoichiometric composition. The R-rich phase becomes correspondingly so small that the above effects (1) through (3) are diminished. It is thus extremely difficult to enhance the coercive force. The high-performance Nd magnet contains, therefore, a very small amount of the R-rich phase, which is active and liable to be seriously oxidized. When the R-rich phase is oxidized in the production process of a magnet, the properties of the magnet are thus liable to deteriorate. In other words, the permissible oxygen amount is lower as the performance of the magnet becomes higher.

The two-alloy mixing method is a recent proposal to solve the problems as described above. The two-alloy mixing method is that the main-phase alloy, the composition of which is close to the stoichiometric $Nd_2Fe_{14}B$ phase on which the magnetism is based, and the boundary-phase alloy having high concentration of a rare-earth element, which alloy is rendered to a liquid phase at sintering to promote sintering and subsequently forms the boundary phase, are prepared separately, and then simultaneously finely crushed or separately crushed followed by mixing. Subsequently, the sintering is carried out by a conventional method.

It is possible to enhance the volume fraction of the boundary-phase alloy in the two-alloy mixing method and to improve the fine dispersion property of the R-rich phase. The oxidation of the more oxidizable boundary-phase alloy than the main-phase alloy during the magnet production process can be prevented by means of adding Co having a chemically stabilizing effect to the boundary-phase alloy prepared in the two-alloy mixing method. This effect is furthermore enhanced by means of adding Co of increased concentration. It is thus possible to produce an improved magnet with low oxygen.

Production of the boundary-phase alloy by means of a conventional ingot-casting method or a super-quenching method is known. No matter which method is employed for producing a boundary-phase alloy, the resultant alloy must be finely crushed by the conventional method. However, the boundary-phase alloy contains a rare-earth element in higher concentration than that contained in the magnet alloy prepared by the conventional single-alloy method; hence, a new phase, which deteriorates the crushability, evolves in the former alloy. The boundary-phase alloy prepared by the heretofore proposed method exhibits extremely poor fine crushability as compared with the magnet alloy produced by the conventional single-alloy method. An important task, therefore, is to improve the crushability of the boudary-phase alloy.

The fine-crushing step comprises the greatest proportion of the cost of the magnet production process and is also important because the properties of the magnet are greatly influenced by such step as follows. Unless the post-crushing average grain-size and distribution of grain size are adequate, the dispersion of the boundary-phase alloy becomes so non-uniform in the magnet alloy that promotion of the liquid phase sintering, and hence high densification of the magnet alloy, become difficult. It also becomes difficult to attain the relatively fine and uniform grain-size which is necessary for obtaining a high performance magnet. It seems that the morphology of the $R_2Fe_{17}$ phase contained in the boundary-phase alloy, such as the volume fraction, size and the like of such phase, plays an important role in the crushability of the boundary-phase alloy. It also seems that the morphology of a richer R-phase (an intermediate phase) than the $R_2Fe_{17}$ phase contained in the boundary-phase alloy is influenced by the morphology of the R-rich phase and plays a role to a less important extent in the crushability of the boundary-phase alloy. It is impossible by means of either the conventional ingot-casting method or the rapid-cooling method to control the morphology of such phases and hence to form a structure attaining improved crushability.

SUMMARY OF INVENTION

It is an object of the present invention to solve the above-described problems and hence to provide a boundary-phase alloy pertinent to the production of a high-performance Nd-based magnet alloy by means of a two-alloy blending method. That is, an alloy, which has improved crushablity, i.e., the most important property in the magnet-production process, is provided.

It is another object of the present invention to solve the above-described problems and hence to provide a method for producing a boundary-phase alloy pertinent to the production of a high-performance Nd-based magnet alloy by means of a two-alloy blending method.

The centrifugal casting method is industrially established as a method for producing tubular castings. In the centrifugal casting method, the melt-feeding method, the casting speed, the cooling method and the like are devised in the present invention, to enable production of a boundary-phase alloy having little segregation and improved crushability. The centrifugal casting method is applied for producing a rare-earth magnet alloy, for example, in Japanese Unexamined Patent Publication No. Hei 1-171,217. This method provides, however, tubular castings which are used as a magnet as they are, and are, therefore, unrelated to the crushing. This publication does not mention at all a technique, according to which the boundary-phase alloy with little segregation and improved crushability, can be produced by means of controlling the casting speed and the like.

In the present invention, influence of the alloy structure upon the fine crushability, which is the most important in the magnet production process, is elucidated in detail. As a result, it was discovered that, among the constituent phases of the boundary-phase alloy, the volume fraction and size of the $R_2Fe_{17}$ phase (a part of Fe may be replaced with another element) exerts great influence upon the fine crushability of the boundary-phase alloy. Thus, the inventive alloy was developed.

More particularly, the present invention is related to an alloy used for the production of a magnet alloy, wherein the alloy consists of from 35 to 60% by weight of at least one rare-earth element (R) selected from the group consisting of Nd, Dy and Pr, and the balance being Fe, the volume fraction of the $R_2Fe_{17}$ phase is 25% or more in the alloy and, further,the average size of $R_2Fe_{17}$ phase is 20 $\mu$m or less. More preferably, the alloy consists of from 35 to 60% by weight of at least one rare-earth element (R) selected from the group consisting of Nd, Dy and Pr, and at least one element selected from the group consisting of 35% by weight or less of Co, 4% by weight or less of Cu, 3% by weight or less of Al and 3% by weight or less of Ga, and the balance being Fe, the volume fraction of the $R_2T_{17}$ phase (T is Fe ore Fe, a part of which is replaced with at least one element selected from the group consisting of Co, Cu, Al and Ga) is 25% or more in the alloy and, further, the average size of the $R_2Fe_{17}$ phase is 20 $\mu$m or less.

The invention of the production method is related to a method for producing an alloy used for the production of a rare-earth magnet, comprising the steps of:

preparing an alloy-melt (a) which consists of from 35 to 60% by weight of at least one rare-earth element (R) selected from the group consisting of Nd, Dy and Pr, and the balance being Fe, and the alloy melt (b), which consists of from 35 to 60% by weight of at least one rare-earth element (R) selected from the group consisting of Nd, Dy and Pr, and at least one element selected from the group consisting of 35% by weight or less of Co, 4% by weight or less of Cu, 3% by weight or less of Al and 3% by weight or less of Ga, and the balance being Fe;

feeding the alloy melt into a rotary tubular mold having an inner surface and onto one or more predetermined portions of the inner surface;

rotating the rotary tubular mold around its longitudinal central axis;

accumulating the alloy melt onto the inner surface of the mold at an average rate of 0.1 cm/second or less; and, centrifugally casting the alloy melt being accumulated at said average rate.

According to an embodiment of the present invention, the cast melt is brought into contact with an inert gas-containing atmosphere, preferably containing 20% or more of helium.

According to another embodiment, a cooling gas, which comprises an inert gas, is blown onto the inner surface of the rotary tubular mold, during the centrifugal casting.

A rare-earth magnet alloy can be produced according to the present invention by the method comprising the steps of:

crushing a first alloy produced by the method of the present invention;

preparing a second alloy having a composition of essentially $R_2Fe_{14}B$;

crushing the second alloy; and, mixing the powder of first and second alloys.

In the alloy composition according to the present invention, at least one rare-earth element (R) selected from the group of Nd, Dy and Pr is 35% by weight or more, so as to attain advantages of the two-alloy mixing method and to appreciably distinguish the composition from that of the single-alloy method. On the other hand, the rare-earth element (R) is 60% by weight or less, because the activity of the alloy becomes so drastically high that the alloy becomes difficult to handle due to oxidation. Furthermore, the ductility is so increased as to make the crushing extremely difficult.

Co is an element that suppresses the oxidation of the boundary-phase alloy and also improves the temperature dependency of the residual magnetic flux density of the sintered magnet upon temperature. The Co content is, however, preferably 35% by weight or less, because the coercive force of the magnet is lowered at more than 35% by weight of Co.

Cu has an effect of minimizing the temperature dependency of the coercive force in the heat treatment which may be carried out subsequent to the sintering in the final magnet production process. Since the coercive force of the Co-added alloy sharply depends on temperature to show a peak, when such alloy is heat-treated in a furnace having temperature distribution, the coercive force becomes unstable, so that the production control becomes difficult. When Cu is further added to the Co-added alloy, the temperature dependence of the coercive force is minimized. The Cu addition enables, therefore, stable enhancement of the coercive force. Furthermore, the Cu addition lowers the melting point of the boundary-phase alloy, thus the liquid-phase sintering is promoted. The Cu content is, however, preferably 4% by weight or less, because the remanence of a sintered magnet becomes low at more than 4% by weight of Cu.

Al and Ga improve the coercive force as well. The content of Al and Ga is preferably 3% by weight or less, because the remanence of a sintered magnet becomes low at more than 3% by weight of Al and Ga.

It was discovered that the volume fraction and size of $R_2T_{17}$ phase, which is one of the constituent phases of boundary-phase alloy, are greatly changed depending upon the casting method and conditions of the boundary-phase alloy. The $R_2T_{17}$ phase is $R_2Fe_{17}$ when the boundary-phase alloy consists of a rare-earth element (R) and Fe. The $R_2T_{17}$ phase is $R_2Fe_{17}$, Fe of which may be partly replaced with Co, Cu, Al or Ga, when the boundary-phase alloy contains these elements.

It was discovered that the fine crushability is improved when the volume fraction of the $R_2T_{17}$ phase is 25% or more and this phase has average size of 20 $\mu$m or less. It was furthermore discovered that, under such structure a phase (hereinafter referred to as the "intermediate phase"), which has an intermediate R content between those of the $R_2T_{17}$ phase and the most R-rich phase, is decreased and finely divided and, this fact improves the crushability. Therefore, the volume fraction of the $R_2T_{17}$ phase is set at 25% or more, and average size of $R_2T_{17}$ phase is set at 20 $\mu$m or less in the present invention. Desirably, the volume fraction of the $R_2T_{17}$ phase is set at 30% or more. The lower limit of the $R_2T_{17}$ phase size is desirably 3 μm or more, because at finer size the orientation degree tends to be low in the compacting step under magnetic field.

The size of the $R_2T_{17}$ phase can be determined for example as follows. A structure-observing photograph by an electron microscope (back-scattered electron image) is used to obtain the number "n" of the phases, which are cut by perpendicular two line segments, and the total length ΣL of the line segments overlapping the phases, and the ΣL/n is calculated, like the cutting method illustrated in JIS G 0552.

As a result of analysis of the intermediate phases by using DX and XRD, it turned out that the intermediate phases are ormed variously depending upon the alloy composition, such as $R_5T_{17}$, $R_1T_3$, $R_1T_2$ and the like.

The melting and casting method is now described. According to the present invention, pure metals, such as a rare-earth element, or mother alloys are melted to provide an alloy under vacuum or an inert-gas atmosphere, such as Ar, as in the conventional method. The melting furnace is not specifically limited. For example, an ordinarily used vacuum induction furnace may be used. The casting after melting is carried out by centrifugal casting. The centrifugal casting apparatus consists basically of a rotary driving mechanism and a tubular mold, as in an apparatus usually used for producing steel tubes or the like. The shape of a mold can be determined by considering the operability, such as easiness in constructing a plant, casting, mold-maintenance and setting, and withdrawal of a cast ingot, while the microstructure of an ingot, which is important in the present invention is not influenced by the shape of a mold. The mold has appropriately an inner diameter of 200 mm or more and length five times or less the inner diameter of the mold, taking into consideration of the above factors.

The rotary speed of a mold may practically be such that the melt does not fall down upon arrival at the top, that is, the rotary speed generates at least 1G of accelerating speed. When the centrifugal force is further increased, the cast melt is liable to spread over the mold wall, thereby enhancing the cooling effect and hence the structure homogenity. In order to achieve these effects, the rotary speed is so set to attain 3G or more, preferably 5G or more.

The melt-feeding rate at the casting is extremely important for the following reasons and is set at a condition completely different from that for obtaining ordinary tubular castings. In the ordinary centrifugal casting, the melt retains the molten state, while it is caused to flow in the longitudinal direction at uniform thickness. In addition, the casting completes in a short period of time so as to avoid the formation of casting defects, such as cold shut.

It is important in the present invention for the previously fed melt into the mold to start to solidify before the succeeding feed of melt. The average accumulating rate of melt onto the in inner surface of a mold should desirably be lower. Specifically, the average accumulating rate is 0.1 cm/second or less, desirably 0.05 cm/second or less. The lower limit of average melt-accumulating rate is desirably approximately 0.005 cm/second in the light of productivity or the like. The average accumulating rate is an increasing rate of the thickness of the casting and is expressed by M/S, in which the melt-feeding amount (volume) per unit time (M) is divided by the total area (S) of mold inner-surface (the area where the melt is fed). By means of casting under such condition, the already cast melt starts to solidify before the next melt is fed. That is, the vicinity of the surface of the cast-metal layer is always under the semi-solidified state. An alloy ingot with fine structure and little segregation can be obtained. Particularly in the case of a boundary-phase alloy used for producing a high-performance Nd magnet, the $R_2Fe_{17}$ phase is of increased volume fraction and is finely dispersed. This results in division of the intermediate phases. An ingot having improved crushability can, therefore, be produced.

Melt must be fed at an amount per unit time exceeding a certain level of flowability such that the melt does not clog the melt-feeding port and trough for feeding the melt onto the inner surface of a mold in the centrifugal casting apparatus. However, along with expansion of the scale of a plant, the melting amount and hence the total area of the mold are increased. It is, therefore, technically easy to set the average accumulating rate at a low value, even without decreasing the feeding amount of melt. Furthermore, the melt can be more thinly fed onto the inner surface of a mold and hence the growth of solidification layer can be promoted by means of feeding the melt onto the inner surface of a mold from two or more nozzles, or reciprocating the feeding port of melt in the longitudinal direction of a mold during casting.

The casting atmosphere should be inert gas such as argon, helium or the like, or a mixture of these gases. Since particularly helium has a high heat conductivity, it enables to increase the cooling rate of melt and ingot. Helium is, therefore, effective for increasing the volume fraction of the $R_2T_{17}$ phase and refining the $R_2T_{17}$ phase. Desirably, the casting is carried out in an inert-gas atmosphere which contains 20% or more of helium, so as to realize the above described effects.

Furthermore, the cooling effect of a mold can be enhanced and hence the solidification can be promoted by means of blowing, during casting, inert gas toward the inner surface of a mold through a gas-cooling nozzle provided in the inner space of a mold. Such a cooling equipment is easy to install within a mold, since a thorough space is provided within the mold of a centrifugal casting apparatus. Inert gas such as argon, helium or the like or mixture of these gases can be used as the blowing gas. Also in this case, pure helium or a helium-containing gas having a high mixture ratio of helium can enhance the cooling rate.

A cast ingot is usually crushed and used for producing a sintered magnet. For crushing, the crusher such as a jet mill, a ball mill or a vibrating mill is used to obtain fine powder approximately from 2 to 6 μm, preferably from 3 to 5 μm in size.

A coating agent is usually preliminarily applied in an apropriate amount onto the inner-surface of a mold in the centrifugal casting method for producing a tubular casting alloy, so as to prevent erosion of the mold, to improve the surface quality and permit easy withdrawal of the cast ingot. The coating agent is also applied on the inner surface of a mold in the case of most conventional casting method of rare-earth magnet alloy as well. Since the coating agent is applied with the aid of a water-containing binder, the coating agent must be thoroughly dried before the casting. Otherwise, the coating agent may be incorporated in the alloy and hence incurs the possibility of detrimental effect on the magnetic properties of a magnet.

Since there is no danger of mold erosion according to the method of the present invention, in which the thermal load per unit surface area of the mold is low, a coating agent is, therefore, not necessarily used in the present invention. The application and drying of the coating agent, the cost of which impedes cost reduction effort, can, therefore, be omitted. The method according to the present invention is, therefore, appropriate as the industrial process.

In the centrifugal casting, a sufficient space is left within a mold even after the casting once terminates. Since it is not an objective of the present invention to obtain a cast tube having a predetermined thickness, the cast product may not be withdrawn out of the mold upon termination of each casting operation. Instead, the next operation can be initiated such that the raw materials of the next batch are loaded and then melted in a crucible, and, then, the laminate casting on the inner surface of the already cast alloy ingot may be implemented. This method decreases such work as preparation of a metallic casting mold, withdrawal of an ingot and the like. The working efficiency can, thus, be enhanced.

The examples of the present invention and the comparative examples are hereinafter described with reference to the following drawings.

EXAMPLES

Examples 1–4

The raw-material alloys were blended to provide the compositions given in Table 1 and melted in a high-frequency vacuum-induction furnace using an alumina crucible under a low-pressure argon-gas environment at 200 torr. Helium gas was admitted, directly before the casting, into the furnace to attain the atmospheric pressure in the furnace. For the casting, the centrifugal casting apparatus was shown in FIG. 1 was used. The inner diameter and length of the mold were 500 mm and 1000 mm, respectively. The casting was carried out at an average accumulating rate of melt of 0.03 cm/second.

Figure 1:
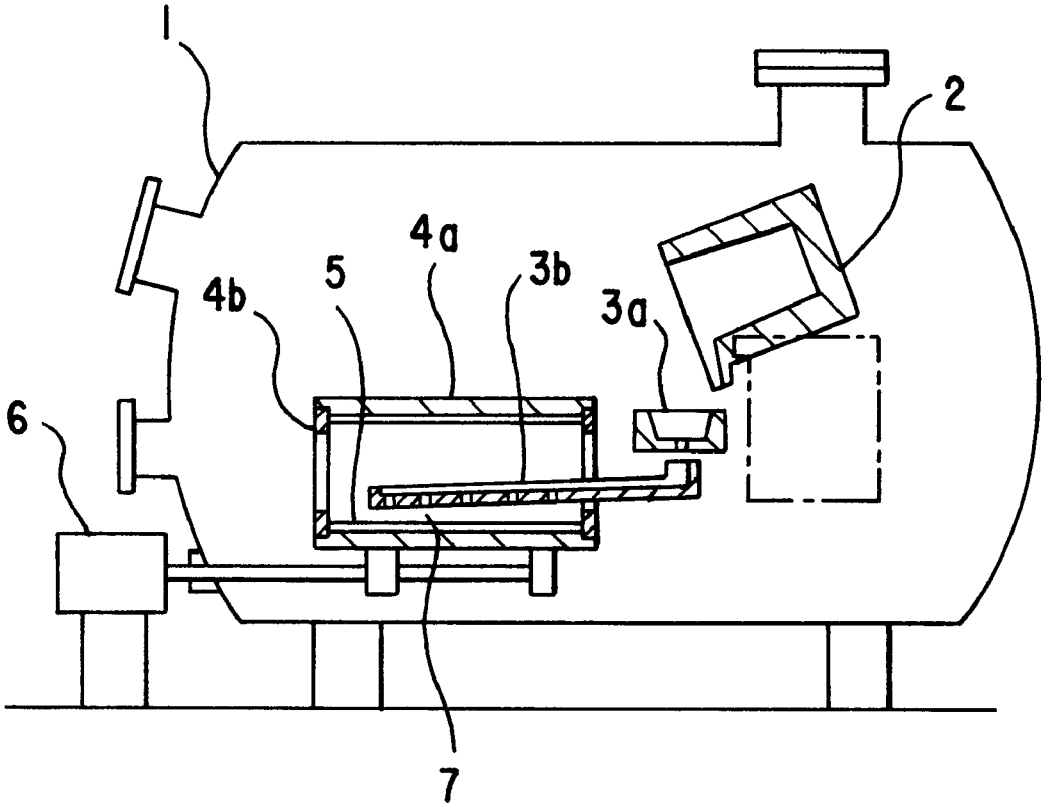
Fig.1 PRIOR ART
FIG. 1 is a general view of the centrifugal casting apparatus used in the examples.

In FIG. 1, 1 denotes the vacuum chamber, in which the crucible 2, the tundish 3*a*, the trough 3*b* and the mold 4*a* are equipped. The mold 4*a* is rotated by a rotary driving mechanism 6. The melt is caused to flow from the crucible 2 through the tundish 3*a* to the trough 3*b*. The melt was poured from it into the mold 4*a* to form an ingot 5 on the inner surface of mold 4*a*. The rotation speed of the mold 4*a* was set at 267 rpm to attain the centrifugal accelerating force of 20G. The trough 3*b*, on which the melt-feeding ports 7 were provided at a distance of 7 cm, was reciprocated in a longitudinal direction of the mold at a stroke of 6 cm and once per second. Thickness of the resultant alloy ingots was 5–6 mm in each case.

Furthermore, the cross-sectional microstructure of the alloy ingots was observed with a back-scattered electron image by using a secondary electron microscope and the volume fraction and size of the $R_2T_7$ phase was measured by an image analyzer. The results are shown in Table 1.

Figure 2:
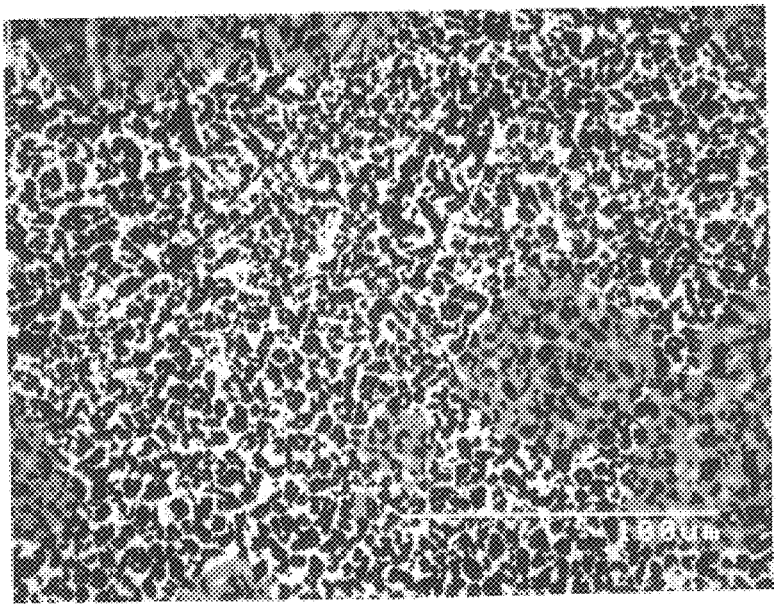
FIG. 2 is a photograph of the back scattered electron image of an alloy ingot obtained in the inventive Example 1 (magnification of 400 times).

Each alloy-ingot had a volume fraction of the $R_2T_{17}$ phase more than 25% and good microstructure. In FIG. 2 is shown the microstructure photograph obtained by the back-scattered electron microscope with regard to the alloy ingot obtained in Example 1. The phases, which appear black in FIG. 2, are the $R_2T_{17}$ phases.

The respective alloy ingots were crushed in argon gas to approximately 5 mm. The powder was held for 1 hour in hydrogen gas at room temperature, then heat-treated at 600° C. under vacuum and crushed by a Brown mill in nitrogen gas to the size under 35 mesh. The crushed powder was further crushed by a jet mill in the nitrogen gas at a feed rate of 80 g/min. The average size of jet-milled particles was measured by a Fisher-type sub-sieve sizer. The results are shown in Table 1. The average size of the jet-milled particles from each alloy ingot was less than 4 $\mu$m.

The crushability is defined by A/80, in which A is the feeding rate in g/min, at which rate the average grain size of 3.5 um is obtained, and is divided by 80 g/min. The crushability indicates, therefore, the crushing efficiency. The greater A/80 is, the better the crushing efficiency, while the crushing efficiency is worse at a value of A/80 closer to zero. The crushability of Examples 1 through 4 is indicated in Table 1. The crushability of each alloy ingot is improved.

Comparative Examples 1–4

The raw-material alloys were blended to provide the same compositions as in Examples 1–4, and were melted in a high-frequency vacuum-induction furnace using an alumina crucible under a low-pressure argon-gas environment at 200 torr. Argon gas was admitted, directly before the casting, into the furnace to attain the atmospheric pressure in the furnace. The melt was then cast into a box-type mold made of iron to form a 20 mm-thick ingot having the compositions as shown in Table 2.

Figure 3:
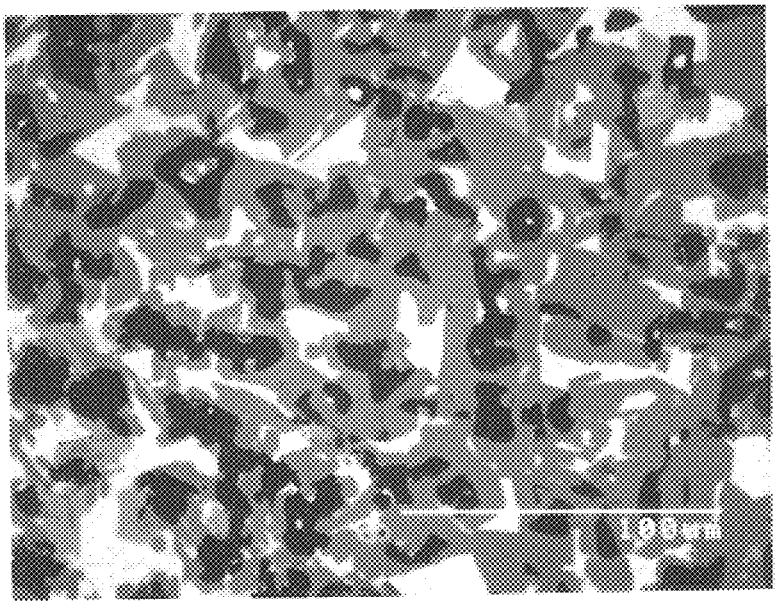
FIG. 3 is a photograph of the back scattered electron image of an alloy ingot obtained in Comparative Example 1 (magnification of 400 times).

The cross-sectional microstructure of the alloy ingots was observed with a back scattered electron microscope and the volume fraction and size of the $R_2T_{17}$ phase was measured by an image analyzer. The results are shown in Table 2. Each alloy-ingot had a volume fraction of the $R_2T_{17}$ phase less than 25%. This microstructure cannot be said to be improved. In FIG. 3 is shown the microstructure photograph obtained by a back scattered electron microscope with regard to the alloy ingot obtained in Comparative Example 1. The phases, which appear black in FIG. 3, are the $R_2T_{17}$ phase.

Examples 5–6

The alloy ingots having the compositions shown in Table 1 were produced by the same centrifugal casting method as in Examples 1 through 4. However, the gas, which was admitted, directly before the casting to attain the atmospheric pressure, was argon gas. In addition, helium gas was continuously blown toward the inner surface of a mold, from the start of casting until thorough cooling of the alloy ingot. Thickness of the resultant alloy ingots was 5–6 mm in each case.

The cross-sectional microstructure of the respective alloy ingots was observed with a back-scattered electron microscope, and the volume fraction and size of the $R_2T_{17}$ phase was formed by an image analyzer. The results are shown in Table 1.

Each alloy-ingot had a volume fraction of the the $R_2T_{17}$ phase more than 25% and an improved microstructure.

The respective alloy ingots were crushed under the same conditions as in Examples 1–4. The average size of jet-milled particles was measured by a Fisher-type sub-sieve sizer. The results are shown in Table 1. The crushability defined in Examples 1 through 4 is also shown in Table 1. The average size of the jet-milled particles was less than 4 $\mu$m in each alloy ingot. The crushability is also improved.

Comparative Examples 5–6

The alloy ingots having the compositions shown in Table 2 were produced by the same method as Comparative Examples 1 through 4, in which the melt was cast into a box mold made of iron to form 20 mm-thick ingots.

The cross-sectional microstructure of the respective alloy ingots was observed with a back-scattered electron microscope, and the image of the $R_2T_{17}$ phase was formed by an image-processing apparatus. The investigated volume fraction and average size of the investigated results of the volume fraction and size of the $R_2T_{17}$ phase are shown in Table 2.

Each alloy-ingot had a volume fraction of the $R_2T_7$ phase less than 25%. It cannot be said that the microstructure is improved.

The resultant alloy ingots were crushed under the same conditions as in Examples 1–4. The average size of jet-milled particles was measured by a Fisher-type sub-sieve sizer. The results are shown in Table 2. The average size of the jet-milled particles was more than 4 μm in each alloy ingot. The crushability defined in Examples 1 through 4 is also shown in Table 2. The crushability was very poor, because the average grain size of the milled particles could not be refined down to 3.5 μm, notwithstanding the fact that the feeder rate was considerably slowed down.

Comparative Examples 7–8

The raw materials were blended to provide the alloy compositions as shown in Table 2. The raw materials were melted in a high-frequency vacuum-induction furnace using an alumina crucible under the low-pressure argon-gas environment at 200 torr. Argon gas was admitted, directly before the casting, into the furnace to attain the atmospheric pressure in the furnace. The melt was then fed onto a water-cooled single roll made of copper, rotating at circumferential speed of 1 m/second to form an ingot in the form of a strip. The resultant each ingot was from 0.2 to 0.3 mm thick.

The cross sectional microstructure of the alloy ingots was observed with a back scattered electron microscope, and the volume fraction and size of the $R_2T_{17}$ phase was measured by an image analyzer. The results are shown in Table 2.

Each alloy-ingot had a volume fraction of the $R_2T_{17}$ phase less than 25%. It cannot be said that the microstructure is improved. Furthermore, the volume fraction of intermediate phases was high, as well.

The resultant alloy ingots were crushed by using a jet mill under the same conditions as in Examples 1–4, to obtain finely milled powder. The average size of finely milled particles was measured by a Fisher-type sub-sieve sizer. The results are shown in Table 2. The average size of the jet-milled particles was more than 4 μm in each alloy ingot. The crushability defined in Examples 1 through 4 is also shown in Table 2. The crushability was very poor, because the average grain size of the milled particles could not be refined as to 3.5 μm, notwithstanding the fact that the feeding rate was considerably slowed down in Comparative Example 7. The average grain size of the milled particles could be as fine as 3.5 μm, at a very slow feeding rate in Comparative Example 8.

Comparative Example 9

An ingot in the form of a strip, having the composition as shown in Table 2, was obtained by the single-roll casting method as in Comparative Examples 7–8. This ingot was further subjected to heat treatment in argon atmosphere at 1000° C. for 24 hours.

The cross-sectional microstructure of the alloy ingot was observed with a back-scattered electron microscope, and the volume fraction and average size of the $R_2T_{17}$ phase formed was investigated by an image-processing apparatus. The investigated results of the volume fraction and size of the $R_2T_{17}$ phase are shown in Table 2. The volume fraction of the $R_2T_{17}$ phase was 30% and high. However, the $R_2T_{17}$ phase was 70 μm in size and large-sized. In addition, the intermediate $R_5T_{17}$ phase coarsely grew to 300 μm.

The resultant alloy ingot was then crushed by using a jet mill under the same conditions as in Examples 1–4 to obtain fine powder. The average size of finely milled particles was measured by a Fisher-type sub-sieve sizer. The results are shown in Table 2. The crushability defined in Examples 1 through 4 is also shown in Table 2. The average grain size of the jet-milled particles was more than 4 μm, and the crushability was poor as well. This seems to be attributable to the fact that, although the $R_2T_{17}$ phase is at high volume fraction, the particles are coarse.

Examples 7–9

An alloy melt, composition of which was 28% by weight of Nd, 1.2% by weight of Dy, 1.2% by weight of B, the balance being Fe, was cast by a single roll method under an argon-gas atmosphere, to form a main-phase alloy in the form of a thin strip. The cooling roll used was a water-cooled roll made of copper, 600 mm in diameter. The circumferential speed was 1 m/second.

The boundary phase-alloys obtained in Examples 1, 3 and 4 in 20% by weight and the main phase alloy in 80% by weight were mixed together. Hydrogen was absorbed in these alloys at room temperature and then emitted at 600° C. The mixture was then roughly crushed to obtain the milled alloy-powder having average size of 15 μm. The fine milling with the use of a jet mill was then carried out to obtain finely milled magnet powder having average size of 3.5 μm. The resultant finely milled powder was compacted under magnetic field of 15 kOe and pressure of 1.5 ton/cm$^2$. The resultant compact was sintered at 1090° C. for 4 hours in vacuum. The first-stage heat treatment was then carried out at 850° C. for 1 hour, and the second-stage heat treatment was carried out at 520° C. for 1 hour. The magnetic properties of the obtained magnets are shown in Table 3. The properties of each magnet are improved.

Comparative Examples 10–13

The boundary phase-alloys obtained in Comparative Examples 1, 7, 8 and 9 in 20% by weight and the main phase alloy in 80% by weight produced by the same methods as in Examples 7–9 were mixed. The magnets were produced as in Examples 7–9. The jet-milled powder mixture had an average size of 3.7 μm and was slightly coarser than that of Examples 7–9. The magnetic properties of the obtained magnets are shown in Table 3.

In Comparative Example 10 (the boundary-phase alloy of Comparative Example 1), since the volume fraction of the $R_2T_{17}$ phase is low, the jet-milled powder of the boundary-phase alloy is of large average grain-size and poor dispersion property. The coercive force is, therefore, low.

In Comparative Example 11 (the boundary-phase alloy of Comparative Example 7) and Comparative Example 12 (the boundary-phase alloy of Comparative Example 8), the volume fraction and size of the $R_2T_{17}$ phase is low. The size of this phase is too small to provide single crystalline $R_2T_{17}$ jet-milled fine powder. The remanence was, therefore, very low.

In Comparative Example 13 (the boundary-phase alloy of Comparative Example 9), since this alloy is heat-treated to increase the volume fraction of the $R_2T_{17}$ phase, the jet-milled fine powder was single crystalline $R_2T_{17}$. The remanence was, therefore, high. However, the jet-milled fine powder was of large average grain size and hence of poor dispersion property. The coercive force was, therefore, very low.

TABLE 1

| | Composition of Alloy Ingot | | | | | | | Casting Condition | | | | $R_2T_{17}$ Phase | | Average grain size of jet-milled powder | |
|---|---|---|---|---|---|---|---|---|---|---|---|---|---|---|---|
| | Nd wt % | Dy wt % | Co wt % | Cu wt % | Al wt % | Ga wt % | Fe wt % | Environment at Casting | Average accumulating rate of Melt cm/sec | Gas Cooling | Thickness of Alloy mm | Volume fraction % | Average size μm | μm | Crushability |
| Example 1 | 43.0 | 1.2 | 15.0 | 2.0 | — | — | Bal | Ar + He | 0.03 | none | 5–6 | 37 | 5 | 3.5 | 1.0 |
| Example 2 | 48.2 | — | — | — | — | — | Bal | Ar + He | 0.03 | none | 5–6 | 40 | 4 | 2.6 | 2.5 |
| Eaample 3 | 38.0 | 10.2 | — | — | 0.9 | — | Bal | Ar + He | 0.03 | none | 5–6 | 33 | 5 | 2.9 | 1.9 |
| Example 4 | 38.0 | 10.2 | — | — | — | 0.9 | Bal | Ar + He | 0.03 | none | 5–6 | 32 | 5 | 2.8 | 2.0 |
| Example 5 | 52.5 | — | 28.2 | 2.0 | 0.9 | — | Bal | Ar | 0.03 | Yes: He | 5–6 | 38 | 6 | 3.7 | 0.8 |
| Example 6 | 52.5 | — | 28.2 | 2.0 | — | 0.9 | Bal | Ar | 0.03 | Yes: He | 5–6 | 39 | 6 | 3.5 | 1.0 |

Pr, which is non-separable from the Nd component, is contained in Nd.

TABLE 2

| | Composition of Alloy Ingot | | | | | | | Casting Condition | | $R_2T_{17}$ Phase | | Average grain size of jet-milled powder | |
|---|---|---|---|---|---|---|---|---|---|---|---|---|---|
| | Nd wt % | Dy wt % | Co wt % | Cu wt % | Al wt % | Ga wt % | Fe wt % | Environment at casting | Thickness of alloy mm | Volume fraction % | Average size μm | μm | Crushability |
| Comparative Example 1 | 43.0 | 10.2 | 15.0 | 2.0 | — | — | Bal | Ar | 20 | 20 | 12 | 4.7 | 0.10 |
| Comparative Example 2 | 48.2 | — | — | — | — | — | Bal | Ar | 20 | 19 | 11 | 3.9 | 0.50 |
| Comparative Example 3 | 38.0 | 10.2 | — | — | 0.9 | — | Bal | Ar | 20 | 21 | 15 | 4.2 | 0.30 |
| Comparative Example 4 | 38.0 | 10.2 | — | — | — | 0.9 | Bal | Ar | 20 | 21 | 13 | 4.4 | 0.20 |
| Comparative Example 5 | 52.5 | — | 28.2 | 2.0 | 0.9 | — | Bal | Ar | 20 | 20 | 16 | 5.0 | ≦0.01 |
| Comparative Example 6 | 52.5 | — | 28.2 | 2.0 | — | 0.9 | Bal | Ar | 20 | 20 | 16 | 5.1 | ≦0.01 |
| Comparative Example 7 | 43.0 | 1.2 | 15.0 | 2.0 | — | — | Bal | Ar | 0.2–0.3 | 9 | 5 | 5.1 | ≦0.01 |
| Comparative Example 8 | 38.0 | 10.2 | — | — | 0.9 | — | Bal | Ar | 0.2–0.3 | 5 | 2 | 4.6 | 0.15 |
| Comparative Example 9 | 38.0 | 10.2 | — | — | 0.9 | — | Bal | Ar | 0.2–0.3 | 30 | 70 | 4.2 | 0.30 |

Pr, which is non-separable from the Nd component, is contained in Nd.

TABLE 3

| | Composition after Mixing of Boundary-Phase Alloy and Main-phase Alloy | | | | | | | | Magnetic Properties | | | |
|---|---|---|---|---|---|---|---|---|---|---|---|---|
| | Nd wt % | Dy wt % | Co wt % | B wt % | Cu wt % | Al wt % | Ga wt % | Fe wt % | Br kG | $_iH_c$ kOe | $(BH)_{max}$ MGOe | Remarks |
| Example 7 | 31.0 | 1.2 | 3.0 | 1.0 | 0.4 | — | — | Bal | 13.6 | 15.5 | 44.7 | Example 1 Centrifugal casting |
| Example 8 | 30.0 | 3.0 | — | 1.0 | — | 0.2 | — | Bal | 13.0 | 18.5 | 40.9 | Example 3 Centrifugal casting |
| Example 9 | 30.0 | 3.0 | — | 1.0 | — | — | 0.2 | Bal | 12.7 | 20.0 | 39.0 | Example 4 Centrifugal casting |
| Comparative Example 10 | 31.0 | 1.2 | 3.0 | 1.0 | 0.4 | — | — | Bal | 13.5 | 12.8 | 43.5 | Comparative Example 1 Centrifugal casting |
| Comparative Example 11 | 31.0 | 1.2 | 3.0 | 1.0 | 0.4 | — | — | Bal | 13.1 | 14.2 | 41.5 | Comparative Example 7 Strip-form ingot |
| Comparative | 30.0 | 3.0 | — | 1.0 | — | 0.2 | — | Bal | 12.5 | 15.9 | 37.8 | Comparative Example 8 |

TABLE 3-continued

| | Composition after Mixing of Boundary-Phase Alloy and Main-phase Alloy | | | | | | | | Magnetic Properties | | | |
|---|---|---|---|---|---|---|---|---|---|---|---|---|
| | Nd wt % | Dy wt % | Co wt % | B wt % | Cu wt % | Al wt % | Ga wt % | Fe wt % | Br kG | $_iH_c$ kOe | $(BH)_{max}$ MGOe | Remarks |
| Example 12 | | | | | | | | | | | | Strip-form ingot |
| Comparative Example 13 | 30.0 | 3.0 | — | 1.0 | — | 0.2 | — | Bal | 12.9 | 16.2 | 39.2 | Comparative Example 9 Strip-heat-treatment |

Pr, which is non-separable from the Nd component, is contained in Nd.

We claim:

1. A cast alloy used for the production of a rare-earth magnet alloy, consisting of from 35 to 60% by weight of at least one rare-earth element (R) selected from the group consisting of Nd, Dy and Pr, and the balance being Fe, the volume fraction of $R_2Fe_{17}$ phase is 25% or more in the alloy and, further, the average size of an $R_2Fe_{17}$ phase is 20 $\mu$m or less.

2. A cast alloy used for the production of a rare-earth magnet alloy, consisting of from 35 to 60% by weight of at least one rare-earth element (R) selected from the group consisting of Nd, Dy and Pr, and at least one element selected from the group consisting of 35% by weight or less of Co, 4% by weight or less of Cu, 3% by weight or less of Al and 3% by weight or less of Ga, and the balance being Fe, the volume fraction of an $R_2T_{17}$ phase (T is Fe, or Fe, a part of which is replaced with at least one element selected from the group consisting of Co, Cu, Al and Ga) is 25% or more in the alloy and, further, the average size of the $R_2T_{17}$ phase is 20 $\mu$m or less.

* * * * *